US007044296B2

(12) United States Patent
Sølling

(10) Patent No.: US 7,044,296 B2
(45) Date of Patent: May 16, 2006

(54) STORAGE DEVICE AND LOCKING DEVICE FOR A DATA CARRIER

(75) Inventor: Tino Sølling, Copenhagen (DK)

(73) Assignee: Scanavo A/S, Copenhagen (DK)

( * ) Notice: Subject to any disclaimer, the term of this patent is extended or adjusted under 35 U.S.C. 154(b) by 21 days.

(21) Appl. No.: 10/398,122

(22) PCT Filed: Oct. 8, 2001

(86) PCT No.: PCT/DK01/00654

§ 371 (c)(1),
(2), (4) Date: Apr. 3, 2003

(87) PCT Pub. No.: WO02/31830

PCT Pub. Date: Apr. 18, 2002

(65) Prior Publication Data

US 2004/0020801 A1 Feb. 5, 2004

(30) Foreign Application Priority Data

Oct. 8, 2000 (DK) ..... 2000 01497

(51) Int. Cl.
*B65D 85/57* (2006.01)

(52) U.S. Cl. ..... 206/308.2; 206/1.5; 206/310

(58) Field of Classification Search .. 206/308.1–308.3, 206/310, 493, 1.5, 807
See application file for complete search history.

(56) References Cited

U.S. PATENT DOCUMENTS 4,425,999 A * 1/1984 MacDonald et al. ..... 206/308.3
5,896,985 A * 4/1999 Nakasuji ..... 206/308.2
6,016,909 A * 1/2000 Chang ..... 206/310
6,478,150 B1 * 11/2002 S.o slashed.lling ..... 206/308.1

FOREIGN PATENT DOCUMENTS

FR 2785439 A1 * 5/2000
WO WO8601929 A1 * 3/1986

* cited by examiner

*Primary Examiner*—Bryon P. Gehman
(74) *Attorney, Agent, or Firm*—Dykema Gossett PLLC

(57) ABSTRACT

A storage device for a data carrier, which includes a base element, holding elements adapted for engaging with an opening in a data carrier, and a locking element adapted for engagement with the storage device in such a manner that the release of a data carrier from the holding elements is prevented until the locking element is removed. The locking element can have a circular cross sectional shape and the storage device includes a recess capable of receiving the circular cross section of the locking element. The holding elements can include two or more arms which upon release of the data carrier are moved towards each other, and the locking element includes a protruding part blocking the movement of the arms towards each other.

3 Claims, 6 Drawing Sheets

STORAGE DEVICE AND LOCKING DEVICE FOR A DATA CARRIER

BACKGROUND OF THE INVENTION

Data carriers of the type relevant for the present invention comprise a carrier surface having a circular outer circumference. The data carrier comprises a central hole. Such data carrier is used for storage of various sorts of data, primarily digital data. Examples of such data carriers are CD's and DVD's, e.g. for music storage, for data program storage, for game storage or for movie storage. The discs have the same physical dimensions.

For the storage of the data carrier itself various storage devices have been used and described.

One example is the commonly known jewel box, which normally is used for storage of music CD's. This previously known box comprise a base plate from which a number of arms project upwardly in a circular arrangement. The arms are flexible and are adapted to hold the CD at the central hole of this when it is pressed downward over the arms. First of all it is difficult to get hold of the disc by hand as the access to the rim of the disc is limited, and secondly the grip actually obtained may be poor, possibly leading to a loss of grip. Furthermore the data-carrying surface of the storage device may contact the base part, which may lead to the loss or damage of data. This in a minor problem in connection with music, since data correction most often is present in the reading devices. In connection with other types of data this may however be crucial It is obvious that this previously known device due to these disadvantages need to be replaced. This has given rise to the development of alternative constructions.

A further previously known device is disclosed in WO 96/14636. This previously known device features a press and release function, which by means of either the flexibility of flexible ejector elements in a base element or the flexibility of the disc itself is intended to eject the disc upon applying a pressure on a locking element holding the disc at the central hole.

A still further prior art storage device is disclosed in EP 0356539. This previously known storage device is like the one described above of the type featuring a press and release function.

In retail commerce it is a significant problem that the content of such storage devices, especially when the content is a DVD disc, is released from the holding means and is removed from the storage device. This takes place even when the storage device is wrapped in a shrink foil, which prevents the immediate opening of the storage device. The method most often used involves providing a slit in the foil at the bottom of the storage device, through which slit the disc may be taken out after release from the holding means. Since the theft alarm means, which is most often used with such products, usually is located on the storage device, the disc may be removed from the store without initiating any alarm It is a common problem for most storage devices, especially for DVD discs, including the before mentioned, that the release of the disc from the holding means is relatively easy to accomplish, either by pressing the storage device in the area of the holding means or by bending of the storage device.

From FR 2785439 a device for retaining a compact disk on a support. The device has a central rosette section with a snap fitting base toothed section for trapping the disk. The main body has flexible axial teeth defining an exterior contour. This comes into contact with the central opening of the disk. The teeth snap into notches of the main rosette and block the movement of the toothed section thereby holding the disk.

Based on this prior art an objective of the present invention is to provide a storage device for a data carrier which has a reliable function and which increases the security against removal of the content from the storage device in any unauthorized or unwanted manner. A further objective is to provide a security device for such storage device which ensures that the content is not removed from the storage device in any unauthorized or unwanted manner.

SUMMARY OF THE INVENTION

According to the invention the first objective is obtained by means of a storage device which includes a base element, holding means connected with the base element for engaging with an opening in a data carrier, and a locking element for engagement with the storage device to prevent release of the data carrier from the holding means until the locking element is removed.

By means of such locking element cooperating with the storage device it is possible to prevent most cases of unauthorized removal of the storage device content from the storage device. This means that a significant source of loss for the storeowners may be eliminated or at least widely reduced. Further it is ensured that tamper evidence is provided, which besides the removal-preventing feature of the basic locking element ensures that the data carrier cannot be removed and used or copied and afterwards returned without visible indicia of the removal. This may substitute other types of tamper evident packaging or sealing.

Advantageous embodiments are depicted in the dependent claims.

By the embodiment of claim 2 it is ensured that a construction comprising a central circular recess is capable of receiving the locking element.

By the embodiment of claim 3 it is ensured that the release of a data carrier from holding means as described is prevented until the removal of the locking element has been effected.

In one embodiment the locking element has a circular cross-sectional shape which can fit into a central circular recess in the storage device.

In another embodiment the holding means includes two or more arms which move towards each other when the data carrier is released and the locking element includes a protruding part which blocks movement of the arms towards each other.

In a further embodiment the locking element includes a releasable part which is connected to a remaining part at a weak or breakable connection area, the releasable part including protruding areas or parts capable of engaging with corresponding parts of the base element or the holding means on the base part to ensure that the locking element can be mounted as a part of the storage device by the storage device manufacturer in such a manner that the locking element afterwards can be handled by automatic packaging machinery and placed in the locking position after insertion of the data carrier.

According to the invention the second objective is achieved by means of a locking element which includes a flexible string that is connected at one end to the locking element and at an opposite second end to the base element.

In connection with a storage device this provides the same advantages as described above in connection with the first objective.

A locking device for use with a storage device of the invention to prevent removal of a data carrier has a circular cross-sectional shape, and it can include a protruding part to block movement of two or more arms of a holding means towards one another. It can include a releasable part that can be broken away from a remaining part at a weak or breakable connection area, the releasable part including protruding areas or parts capable of engaging with corresponding parts of a base element of a storage device. The locking device can include a flexible string which connects it to the base element.

By the embodiment of claim 6 it is ensured that a construction comprising a central circular recess is capable of receiving the locking element.

By the embodiment of claim 7 it is ensured that the release of a data carrier from holding means as described is prevented until the removal of the locking element has been effected.

By the embodiment of claim 9 it is ensured that the locking element can be mounted as a part of the storage device by the storage device manufacturer in such a manner that the locking element afterwards can be handled by automatic packaging machinery and placed in the locking position after insertion of the data carrier.

The invention will be described more detailed in the following description of a preferred embodiment, with reference to the drawings.

DESCRIPTION OF THE PREFERRED EMBODIMENT

Figure 1:
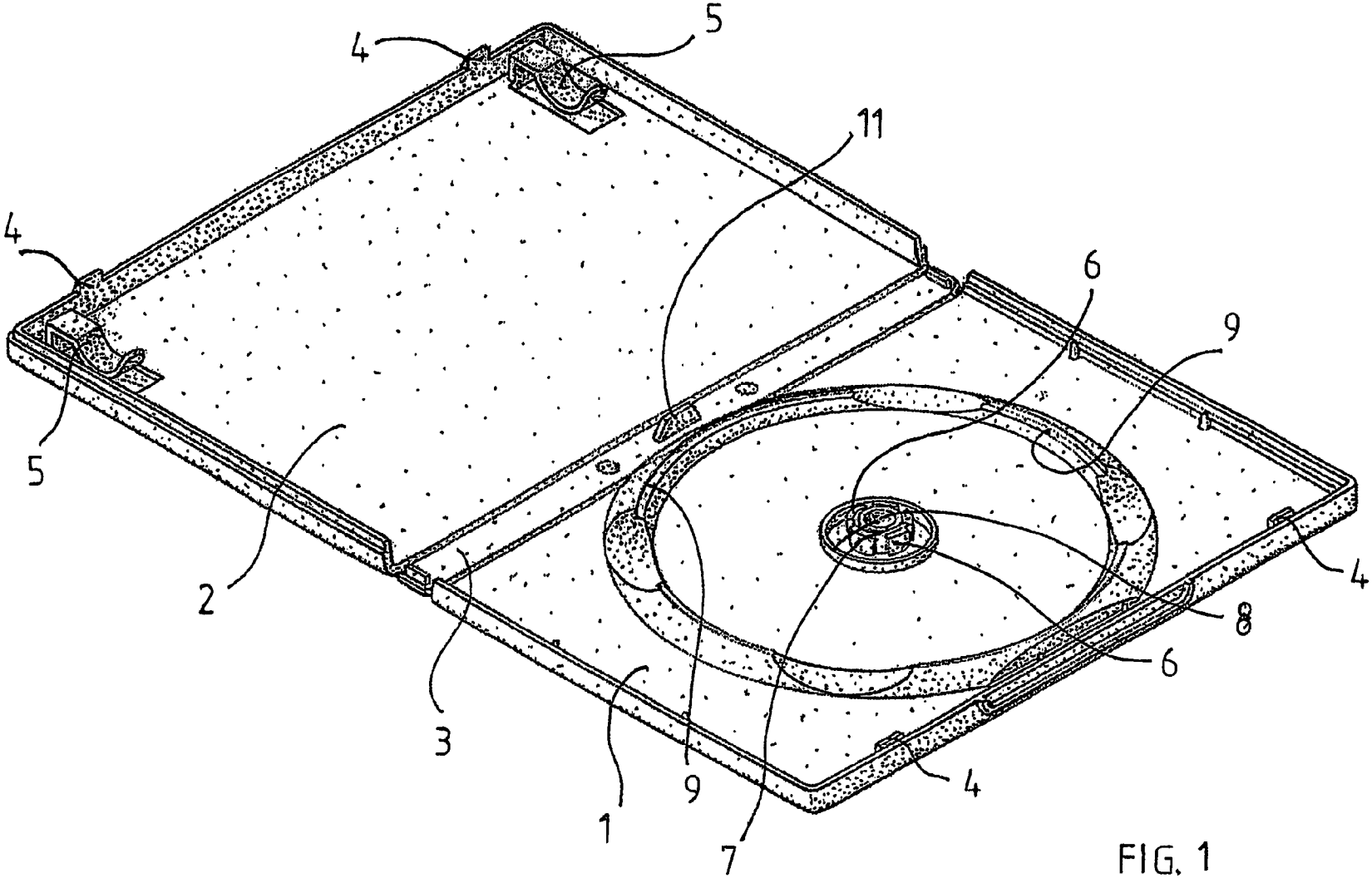
FIG. 1 is a perspective view of a preferred embodiment of the storage device according to the invention.

From FIG. 1 a storage device appears in the form of a box comprising a base element 1 and a lid 2. The base element and the lid are pivotally connected to a back element 3 and comprise means 4 for interlocking the two parts in a releasable manner. The lid comprises two flexible elements 5 for holding an insert.

Figure 2:
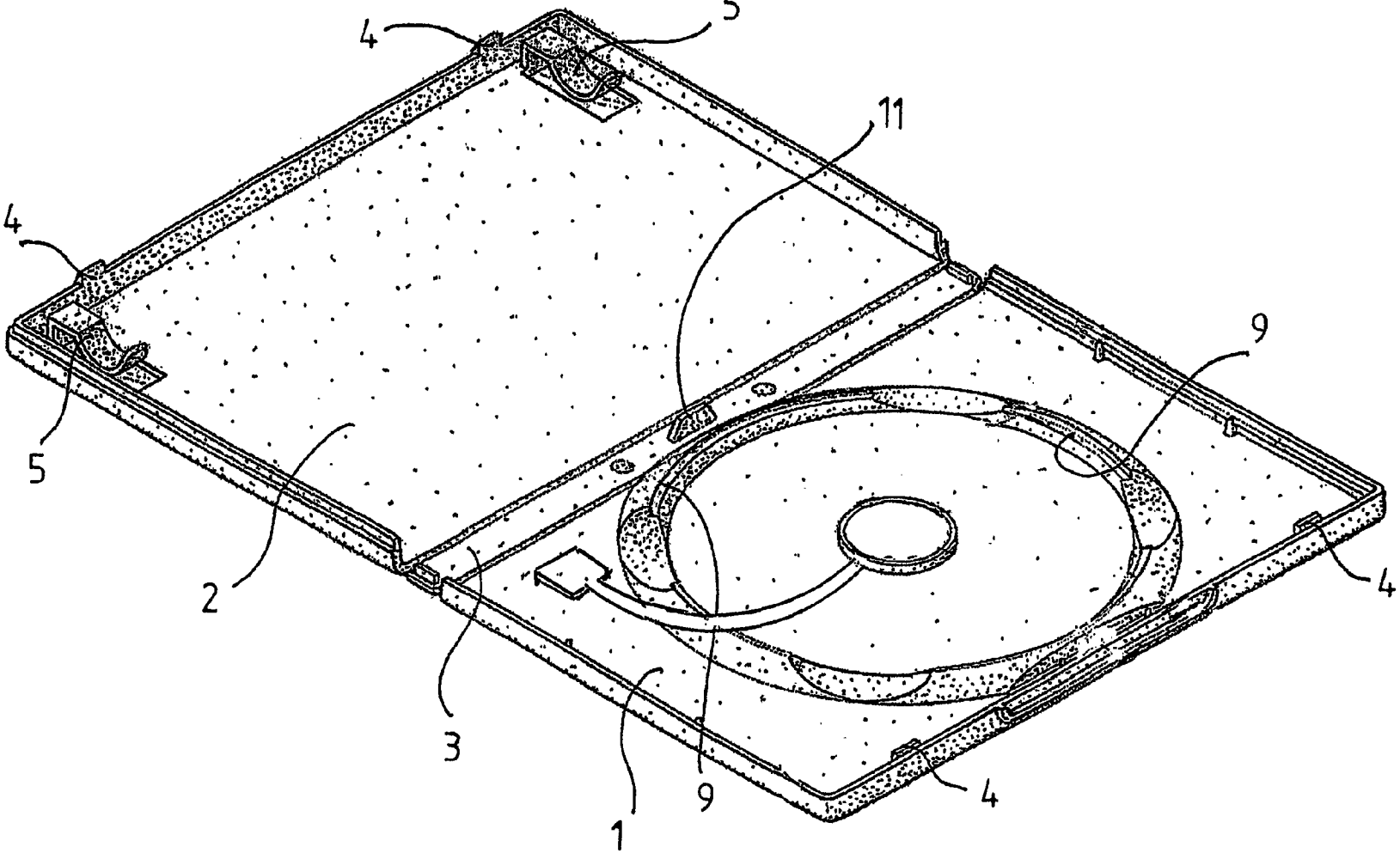
FIG. 2 is a perspective view of a preferred embodiment of the storage device according to the invention, where a locking element has been mounted.
Figure 6:
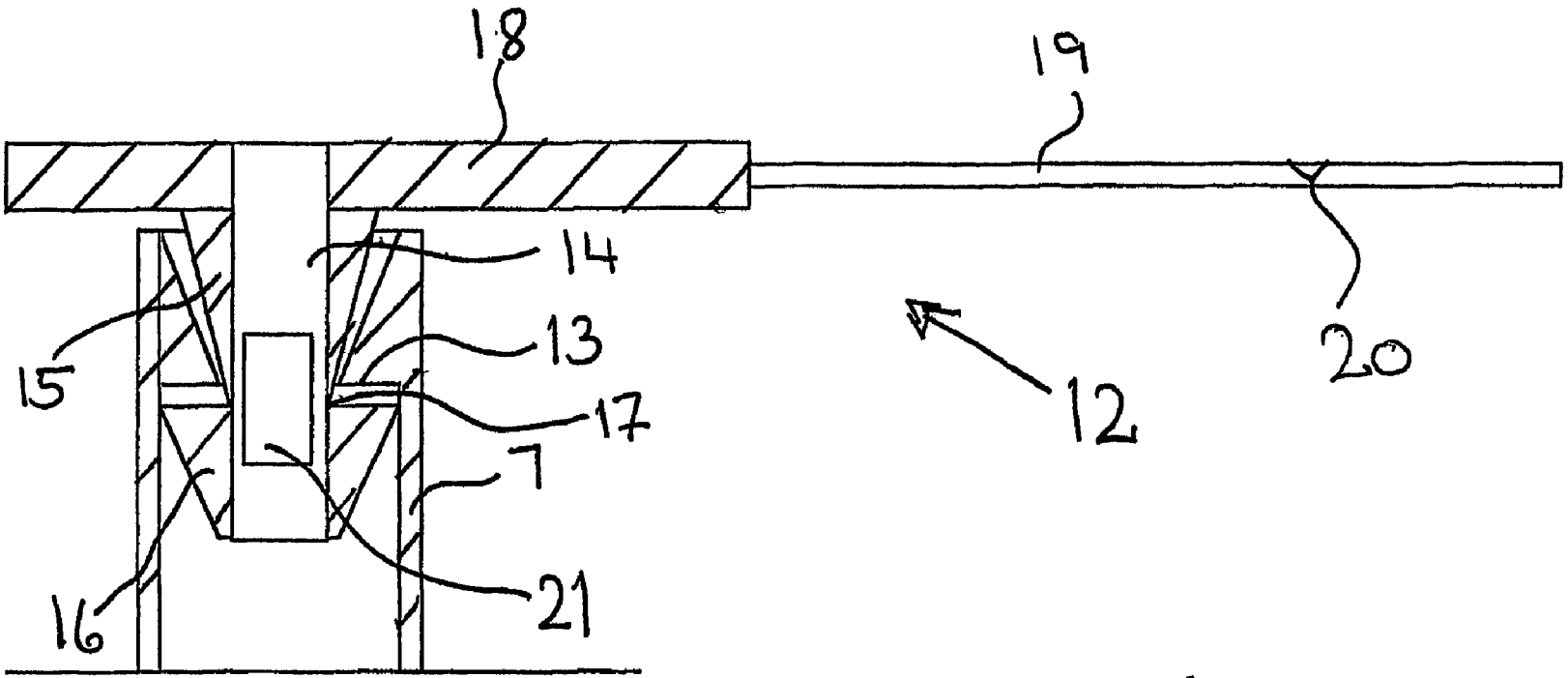
FIG. 6 is an enlarged view of a part of the storage device as shown in FIG. 5.

The base element comprises a number of arms 6 extending perpendicular to the base element; in this case five arms 6. The number of arms may be lower or higher, but it has shown to be convenient that the number is of the order of four to six. Hereby the arms comply with the required rigidity and strength when the box is moulded from a soft plastics material in an injection moulding process. The arms are arranged in a circular order corresponding to the diameter of the hole in the data carrier. Within the circle of the arms a movement-limiting element 7 or a stop is provided in the form of a cylindrical element. By means of this it is possible to avoid a possible fatigue of the arms 6 due to several to extensive bending operations of these. Furthermore this element 7 serves as a rest for the users one finger when removing the data carrier from the storage device. In this manner the arms are freely movable without influence from the users finger. Surrounding the arms a circular support element 8 is provided to support the data carrier close to the central hole, preferably outside the data carrying area At a further distance from the arms a number of discrete support elements 9, four in all, are provided for supporting the outer rim of the data carrier. The discrete support elements are provided with a mutual distance, which allows the user to access the rim of the data carrier in a safe and reliable manner. The area between the discrete support elements is formed by curved recesses, which when abutting the central element 7 with one finger allows for gripping the rim of the data carrier with another finger, preferably the thumb, whereby the data carrier may be released in the desired safe and reliable manner. A locking element is indicated by 12 in FIG. 2. This is described in more detail in connection with FIG. 6.

Figure 3:
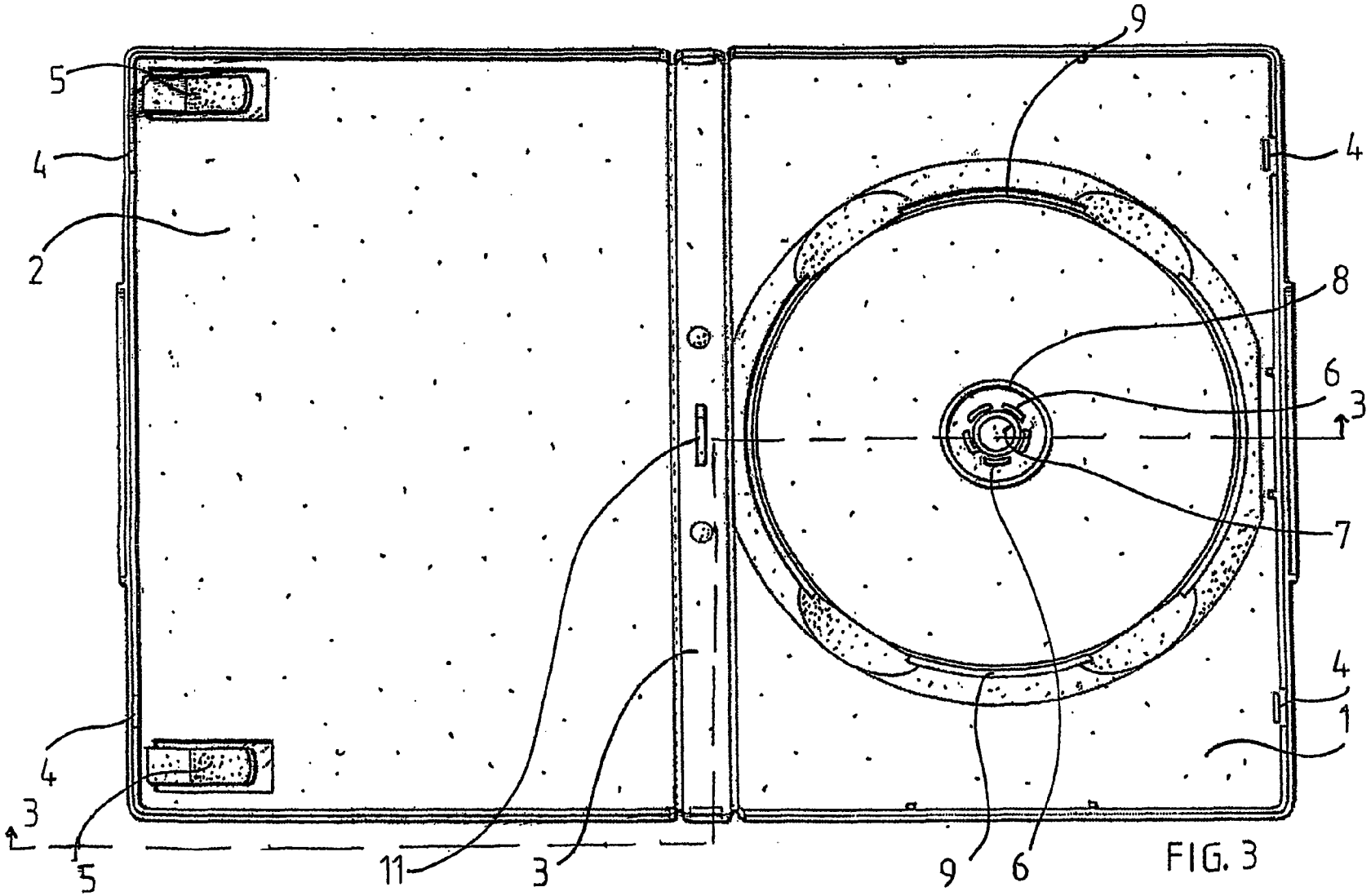
FIG. 3 is a top view of the storage device shown in FIG. 1.

From FIG. 3 the features shown on FIG. 1 and described above becomes apparent. From FIG. 4 the locking element 12 becomes apparent as well.

Figure 5:
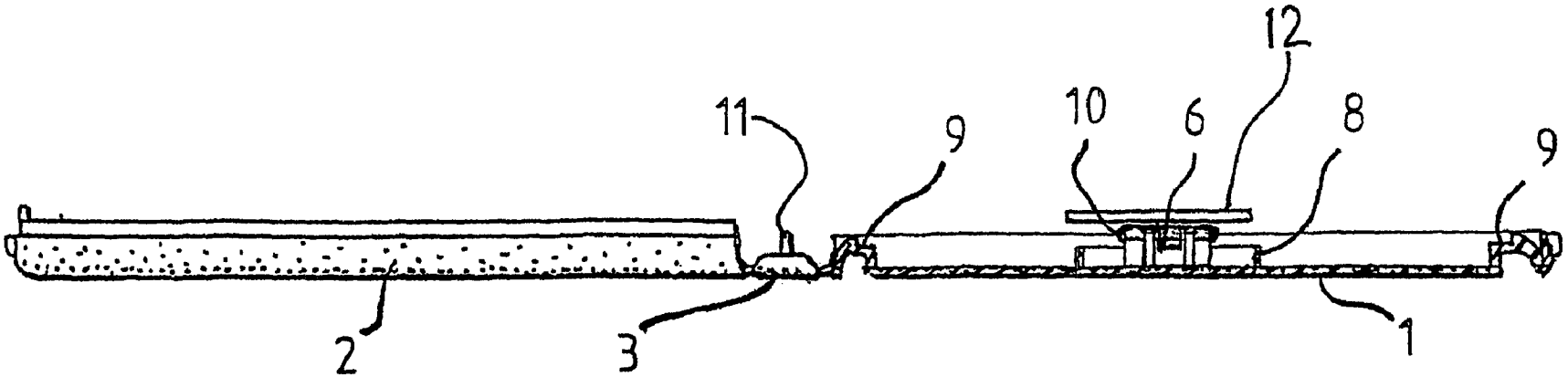
FIG. 5 is sectional view according to the line 3—3 in FIG. 4.

From FIG. 5, which is a sectional view, the arms are shown in more detail It becomes apparent that the arms 6 each comprise a radial outward extending protrusion 10, which serves the purpose of locking the data carrier when the hole of this is pressed downwards over the arms. The locking element 12 appears.

On the inside of the back element 3 a holding element 11 appears in the form of a fin. The holding element serves the purpose of preventing the disc from being released from the central holding element as the holding element protrudes beyond the area 9 when the storage device is closed. When the storage device is in its open position as shown in FIGS. 1–5 the holding element is in a neutral position. Further such holding elements may be provided in the lid part 2.

The arms 6 may be arranged in such a manner and with such dimensions that the disc once placed and secured may be turned with very limited friction, which will allow the user to read text on the disc with out removing the disc from the storage device or without tuning the latter.

The area 8 may be slightly higher than the area 9, hereby allowing a disc to be turned without contact at the outer circumference.

Figure 4:
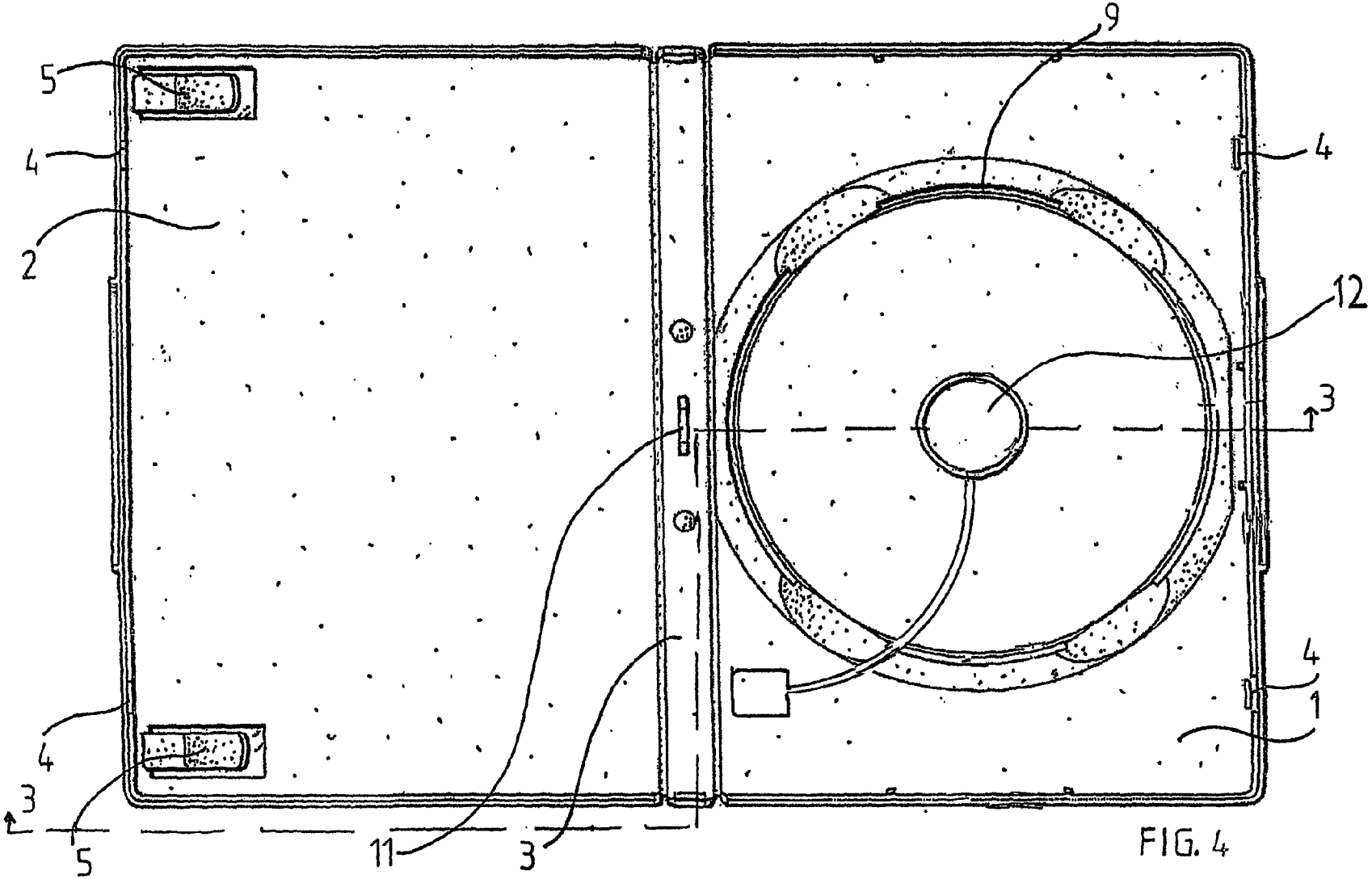
FIG. 4 is a top view of the storage device shown in FIG. 1 where a locking element has been mounted.

From FIG. 4 it appears that the cylindrical element 7 has on the inside a circumferential edge 13. A plug 14 is provided having a first conical section 15 and a second conical section 16, where these are interconnected at a breakable area 17 consisting of a thin material area A top part 18 extending over the data carrier prevents the removal of this before the plug is removed The removal of the plug can only take place by breaking the interconnecting area 17 between the two conical parts. In this way the plug may also provide for tamper evidence since the removal of the disc is not possible without breaking the seal. The top part 18 is connected to the base element by means of a flexible connecting member 19 that may, at the end opposite the top part, be glued or welded to the base element of the storage device. A further weakening area 20 may be provided near the area of connection between the base element and the connecting member in order to allow easy removal of the remains of this after removal of the plug from the initial position blocking the data carrier. One or more openings 21 or cut-outs may be provided in the plug in the area where this has to pass the narrow area of the engagement means on the base element or the holding means in order hereby to allow a certain deformation of the plug in this area, without loosing the effect of engagement with the engagement means adapted for this.

Another possibility of realizing the invention does exist in providing the means as described in the foregoing and also in the claims in a manner where the releasable part is a part integrated in the storage device itself Furthermore the engagement means may be provided in a reverse manner on the locking element and the storage device, respectively, without this changing the scope of the invention The locking element may be adapted to be mounted and locked on the outer side of parts of the holding means or the storage device, where in the foregoing only the insertion of a plug into a cavity has been exemplified.

What is claimed is:

1. A combination of a storage device and a data carrier having a circular opening therein, said storage device comprising:

a base member including holding means which can extend through said opening in said data carrier to mount said data carrier to the storage device, said holding means comprising a plurality of arms which are mounted in a circle and which can flex radially inwardly to release the data carrier mounted therearound, a circular stop element which is located radially inwardly of the arms to limit inward flexible movement thereof, said circular stop element defining a channel therewithin and including a radially-inwardly extending flange, and a locking device including a plate member which is positionable over said circular stop element and a plug member which extends from said plate member into said channel, said plug member including a first portion nearest the plate member, a second portion remote from the plate member, and an area of reduced cross section between said first and second portions into which said radially-inwardly extending flange of said circular stop element extends, said second portion of said plug member being separated from said first portion at said area of reduced cross section with removal of said plate member from over said circular stop element.

2. A combination according to claim 1, wherein said first and second portions of said plug member are cone shaped.

3. A combination according to claim 1, including a flexible connecting member that extends between said plate member and said base member.

* * * * *